US008424866B2

(12) United States Patent
Ikeda

(10) Patent No.: US 8,424,866 B2
(45) Date of Patent: Apr. 23, 2013

(54) SHEET FEEDING APPARATUS AND IMAGE FORMING APPARATUS

(75) Inventor: Taro Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

(21) Appl. No.: 13/181,378

(22) Filed: Jul. 12, 2011

(65) Prior Publication Data

US 2012/0025446 A1 Feb. 2, 2012

(30) Foreign Application Priority Data

Jul. 27, 2010 (JP) ..... 2010-168045

(51) Int. Cl.
*B65H 3/14* (2006.01)

(52) U.S. Cl.
USPC ..... 271/98; 271/97

(58) Field of Classification Search ..... 271/90, 271/97, 98, 105
See application file for complete search history.

(56) References Cited

U.S. PATENT DOCUMENTS 5,092,576 A * 3/1992 Takahashi et al. ..... 271/3.11
6,629,692 B2 * 10/2003 Allner et al. ..... 271/98
7,490,826 B2 * 2/2009 Takai et al. ..... 271/98
7,549,629 B2 * 6/2009 Tateishi et al. ..... 271/98
7,913,993 B2 * 3/2011 Kosugi et al. ..... 271/98
8,042,798 B2 * 10/2011 Suzuki ..... 271/98
2005/0040584 A1 * 2/2005 Isemura ..... 271/97
2007/0222138 A1 9/2007 Ikeda
2010/0187747 A1 * 7/2010 Kannari et al. ..... 271/3.16

* cited by examiner

*Primary Examiner* — Kaitlin Joerger
*Assistant Examiner* — Ernesto Suarez
(74) *Attorney, Agent, or Firm* — Canon USA, Inc., IP Division

(57) ABSTRACT

A sheet feeding apparatus may include a sheet storage unit, an air blowing unit, a suction conveyance unit, and a conveyance guide. A sheet in the sheet storage unit blown by the air blowing unit may be conveyed to the conveyance guide by the suction conveyance unit. The conveyance guide has a guide surface and inclined portions arranged upstream in the sheet conveyance direction, formed therein from a sheet conveyance center to ends in a sheet width direction perpendicular to the sheet conveyance direction. The inclined portions are inclined from the upstream side towards the downstream in the sheet conveyance direction. As a distance in which an inclined portion resides away from the suction conveyance unit increases, the inclined portion becomes positioned more upstream in the sheet conveyance direction.

10 Claims, 9 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and more particularly, to a configuration in which a sheet is separated and fed by blowing air onto the sheet.

2. Description of the Related Art

Conventionally, in an image forming apparatus such as a copying machine, a sheet feeding apparatus of an air feeding type using air has been discussed to feed, from a sheet storage unit in which sheets are stacked and stored, the sheets one at a time. The sheet feeding apparatus blows air onto upper edges of the stacked sheets to float and loosen a plurality of sheets, and then attracts only one of the sheets to a suction conveyance belt arranged in its upper part and conveys the sheet.

The sheet feeding apparatus of an air feeding type blows air from a loosening nozzle 33 onto front edges of sheets S stored in a sheet storage unit 100 to float a plurality of upper sheets to loosen the sheets, as illustrated in FIG. 6. The uppermost sheet is attracted to a suction conveyance belt 21 at negative pressure. At that time, the uppermost sheet is separated from the sheets S by air blown from a separation nozzle 34. The uppermost sheet that has been attracted to the suction conveyance belt 21 is conveyed when the suction conveyance belt 21 rotates, and is conveyed to a drawing roller pair 105 located downstream while being guided by a conveyance guide 15.

FIG. 7 is a side view of the sheet feeding apparatus illustrated in FIG. 6 as viewed from the left. The center of the floated sheet S is floated by air blown form the loosening nozzle 33. However, both edges of the sheet S in a sheet width direction perpendicular to a sheet conveyance direction cannot be floated but hang because air is not blown thereto. Particularly, a difference in height most significantly appears for an uppermost sheet Su that has been attracted to the suction conveyance belt 21 (indicated by B-P in FIG. 7). The larger the size of the sheet S becomes, or the lower the rigidity of the sheet S becomes, the larger the difference in height becomes. When the sheet S is conveyed in this state, the sheet S may be folded at its corner of the leading edge or jammed.

A technique for solving this issue is discussed in U.S. Patent Publication Application No. 2007/222138. The technique relates to a conveyance guide 15 having a shape as illustrated in FIG. 8. A guide surface of the conveyance guide 15 has, in a sheet conveyance direction indicated by an arrow A in FIG. 8, inclined portions 15A and 15B which are inclined from the upstream side to the downstream side, and formed therein from the center to both ends in a sheet width direction.

FIGS. 9A and 9B illustrate how an edge of a sheet S to be conveyed in a hanging state by the conveyance guide 15 is lifted as the sheet S is conveyed. More specifically, the edge of the sheet S, which has been attracted to a suction conveyance belt 21, hangs before it abuts on an end portion of the upstream side of the conveyance guide 15 in the sheet conveyance direction. When the suction conveyance belt 21 conveys the sheet S, the edge of the sheet S contacts a point 15A1 of the inclined portion 15A of the conveyance guide 15 (the sheet S is in a state Sa), and the sheet S is lifted along the inclined portion 15A.

As the sheet S is further conveyed, its contact point with the inclined portion 15A gradually moves to points 15A2 and 15A3 outside the sheet S, and the sheet S is changed to states Sb and Sc respectively. More specifically, the sheet S can be smoothly guided to a sheet conveyance unit located downstream while the inclined portion 15A of the conveyance guide 15 lifts a hanging portion of the sheet S. Therefore, even if the sheet S is in a hung state, the sheet can be satisfactorily conveyed without being folded at the corner or jammed.

A rate of occurrence of corner folding at the edge or jamming of a sheet can be significantly reduced by providing the above-described conventional conveyance guide. However, the above-described conventional conveyance guide cannot sufficiently handle coated paper having a grammage of less than 80 g/m$^2$, non-coated paper having a grammage of less than 50 g/m$^2$, a large-sized sheet having a length of more than 13 inches (approximately 330 mm) in a direction perpendicular to the conveyance direction, or a sheet having an edge previously curled. More specifically, the above-described conventional conveyance guide cannot sufficiently lift the sheet of these types since its edge too greatly hangs, so that the rate of occurrence of corner folding or jamming may be increased. Further, in a use environment where the sheet absorbs moisture and its edge greatly hangs, the rate of occurrence of corner folding or jamming is further increased.

SUMMARY OF THE INVENTION

The present invention is directed to a sheet feeding apparatus of an air feeding type which can reliably prevent a sheet from being folded at the corner or jammed.

According to an aspect of the present invention, a sheet feeding apparatus includes: a sheet storage unit configured to store sheets; an air blowing unit configured to blow air onto the sheets stored in the sheet storage unit; a suction conveyance unit arranged in an upper part of the sheet storage unit and configured to attract and convey a sheet that is floated by air blown by the air blowing unit; a sheet conveyance unit arranged downstream in a sheet conveyance direction of the suction conveyance unit and configured to convey the sheet which is conveyed by the suction conveyance unit, downstream; and a conveyance guide which has a guide surface configured to guide a sheet to be attracted by the suction conveyance unit and conveyed to the sheet conveyance unit, wherein the conveyance guide has inclined portions which are arranged upstream in the sheet conveyance direction, formed therein from a sheet conveyance center to ends in a sheet width direction perpendicular to the sheet conveyance direction, and inclined from the upstream side towards the downstream in the sheet conveyance direction, wherein a plurality of inclined portions is provided in a direction away from the guide surface of the conveyance guide, and wherein as a distance in which an inclined portion resides away from the suction conveyance unit increases, the inclined portion becomes positioned more upstream in the sheet conveyance direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 5:
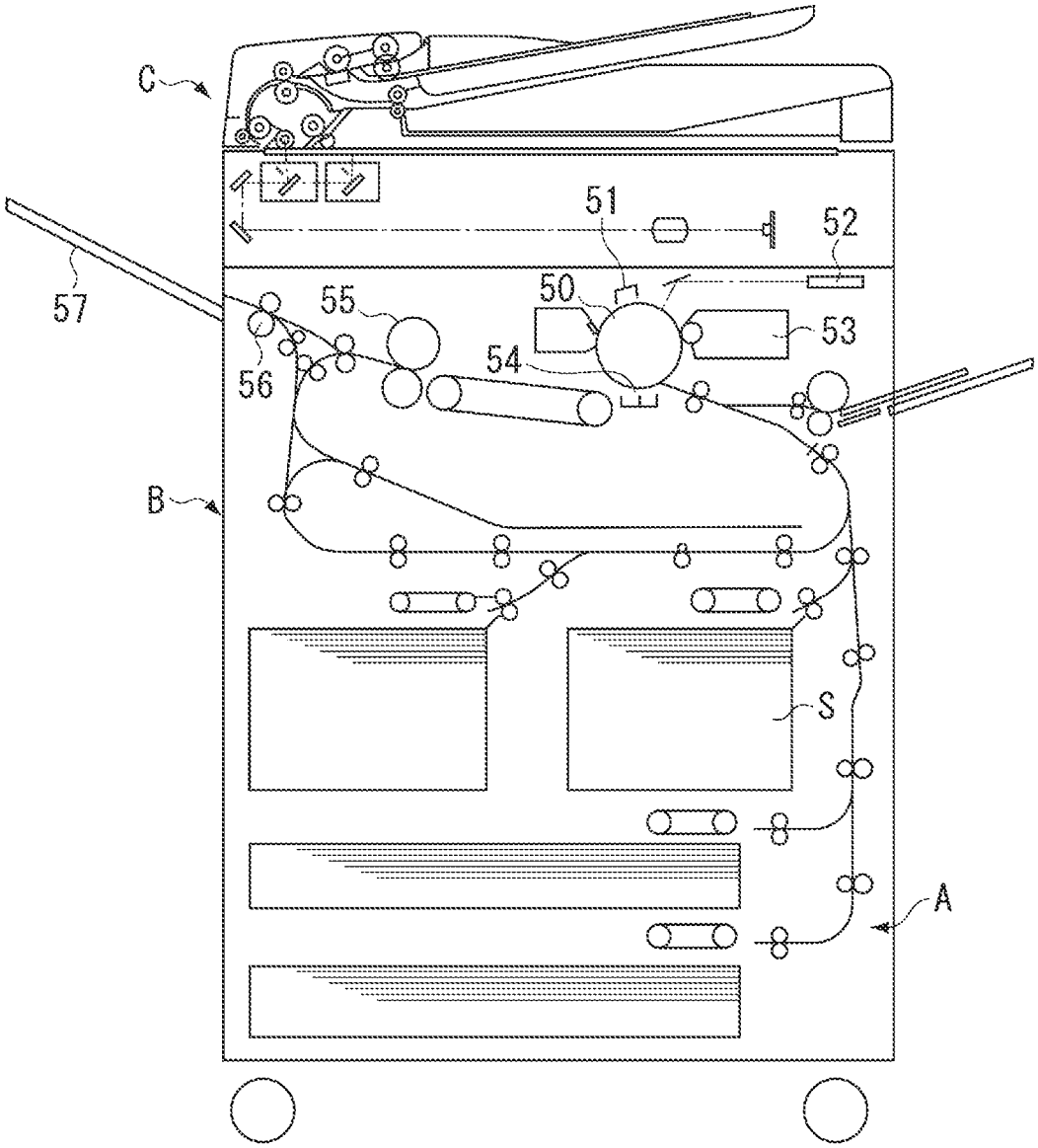
FIG. 5 is a cross-sectional view of an image forming apparatus on which the sheet feeding apparatus illustrated in FIG. 1 is mounted.

A sheet feeding apparatus according to an exemplary embodiment and an image forming apparatus including the same will be described below with reference to the drawings. First, the entire configuration of the image forming apparatus, together with an image forming operation, will be described. FIG. 5 is a schematic sectional view illustrating the image forming apparatus including the sheet feeding apparatus.

As illustrated in FIG. 5, in the image forming apparatus according to the present exemplary embodiment, a sheet feeding apparatus A is arranged in a lower part of an apparatus main body, and an image forming unit B for forming an image on a sheet fed from the sheet feeding apparatus A is arranged in an upper part of the apparatus main body. An image reading unit C, which conveys a document to optically read information relating to the document and converts the information into a digital signal to obtain an image signal, is arranged in an upper part of the apparatus main body.

In the image formation, the image signal read by the image reading unit C is transmitted to the image forming unit B, and an image is formed on the sheet based on the image signal. The image formation in the present exemplary embodiment is performed using an electrophotographic method. More specifically, when an image formation signal is input, a photosensitive drum 50 rotates while its surface is charged by a charging device 51. The photosensitive drum 50 is irradiated with a laser beam from a laser scanner 52 based on the above-described read image signal, and an electrostatic latent image is formed on the photosensitive drum 50. The electrostatic latent image is developed with toner by a development device 53 and visualized as a toner image.

On the other hand, the sheet fed from the sheet feeding apparatus A is conveyed to an area between the photosensitive drum 50 and a transfer charging device 54 in synchronization with the formation of the toner image, and the toner image on the photosensitive drum 50 is transferred onto the sheet by applying a bias to the transfer charging device 54. The sheet is conveyed to a fixing device 55, and the toner image is fixed onto the sheet by heating and pressurization. Then, the sheet is discharged to a discharge tray 57 by a discharge roller pair 56.

Figure 6:
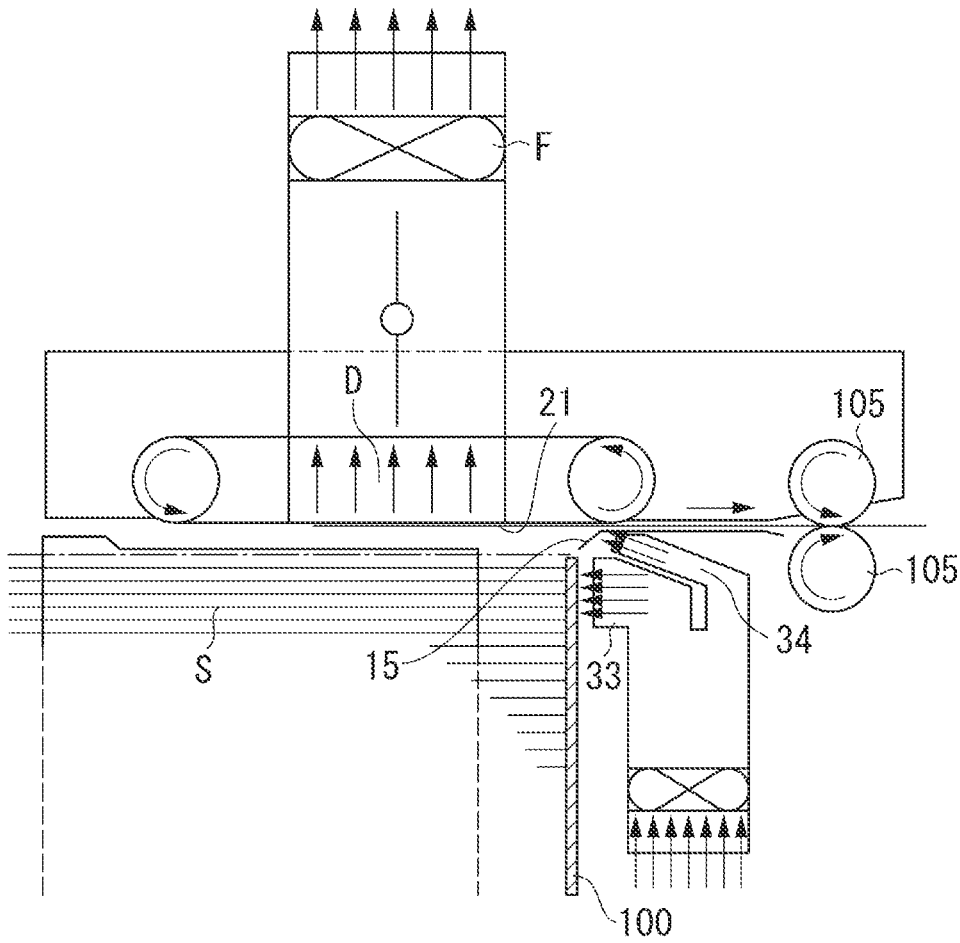
FIG. 6 is a cross-sectional view illustrating a conventional sheet feeding apparatus.
Figure 7:
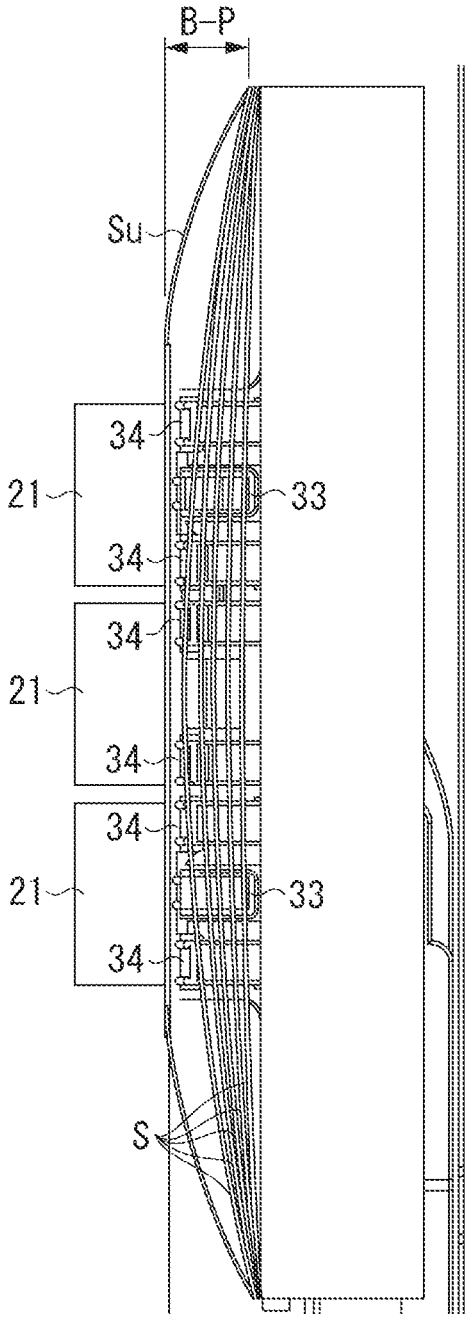
FIG. 7 is a front view illustrating a state of a sheet during an operation of the conventional sheet feeding apparatus.

The sheet feeding apparatus A has a configuration similar to that illustrated in FIG. 6 described in the conventional technique except for a configuration of a conveyance guide.

In FIG. 6, sheets S are stored on a tray (not illustrated) in a sheet storage unit 100. In the sheet storage unit 100, a lifter driving mechanism (not illustrated) raises a lifter, as needed, so that an upper surface of the uppermost one of the stored sheets S is in a height range in which the sheet can be fed. A plurality of loosening nozzles 33 and a plurality of separation nozzles 34 are arranged as an air blowing unit on the front side in a feeding direction of the stored sheets S. A suction conveyance unit for attracting and conveying the uppermost sheet is provided above the sheet storage unit 100.

The suction conveyance unit includes a suction conveyance belt 21 and a duct D which is arranged inside the suction conveyance belt 21 and brought into negative pressure generated by a fan F. Ambient air is sucked in from an opening formed on a lower surface of the duct D and a suction hole formed on a peripheral surface of the suction conveyance belt 21, so that the sheets S are attracted to the suction conveyance belt 21. A conveyance guide 65 is provided below the suction conveyance belt 21 and downstream in the sheet feeding direction. The conveyance guide 65 has a guide surface for guiding the sheet to be attracted and conveyed by the suction conveyance belt 21 toward a drawing roller pair 105 arranged downstream. A configuration of the conveyance guide in the present exemplary embodiment differs from that of the conveyance guide 15 described in the conventional technique, thus the reference numeral 65 is assigned thereto.

An operation of the sheet feeding apparatus having the above configuration will be described. The loosening nozzle 33 blows air onto an edge of a sheet bundle stored in the sheet storage unit 100, to float and loosen a plurality of upper sheets. When the uppermost sheet is attracted to the suction conveyance belt 21 at negative pressure, the sheets are separated into the uppermost sheet by air blown from the separation nozzle 34. Then, the uppermost sheet that has been attracted to the suction conveyance belt 21 is conveyed by the rotation of the suction conveyance belt 21, and is fed to the drawing roller pair 105 serving as a sheet conveyance unit arranged downstream while being guided by a guide surface 65*f* that is an upper surface of the conveyance guide 65.

Figure 1:
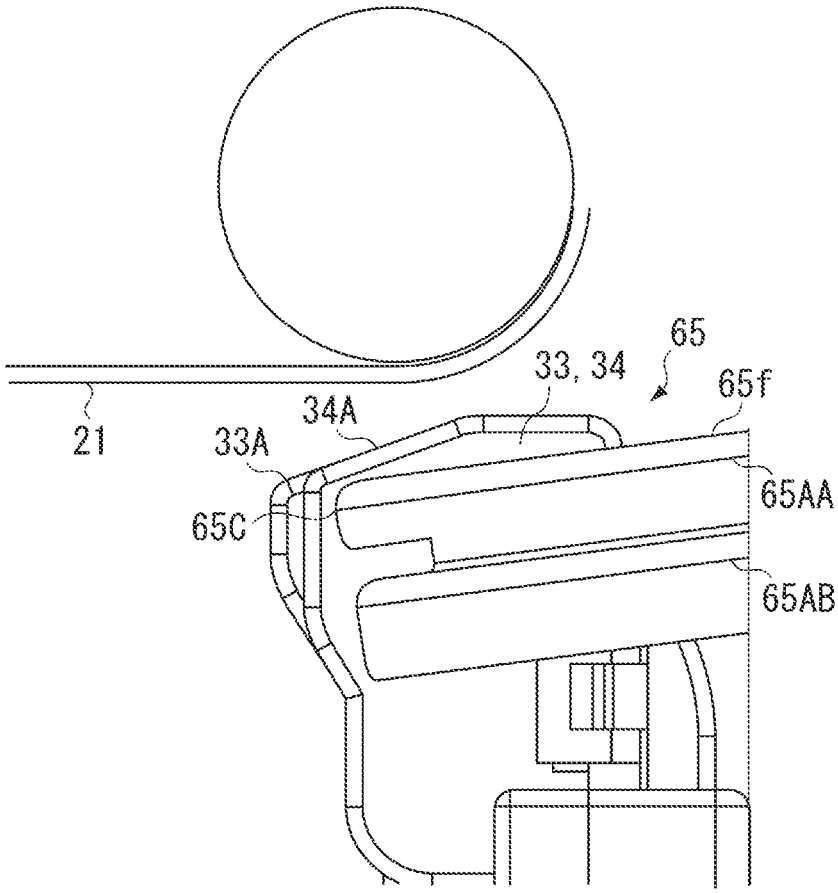
FIG. 1 is a side view illustrating an example of a sheet feeding apparatus.

FIG. 1 is a front view of the conveyance guide 65 according to the present exemplary embodiment (a side view as viewed in a horizontal direction perpendicular to the sheet conveyance direction). The conveyance guide 65 according to the present exemplary embodiment is arranged with the guide surface 65*f* for guiding a sheet hardly inclined, as viewed from the horizontal direction perpendicular to the sheet conveyance direction, as illustrated in FIG. 1. The guide surface 65*f* is slightly inclined to reliably transfer a leading edge of the sheet thereto such that a leading edge portion 65C near the center of the conveyance guide 65 is lower than a sheet passing rib surface 33A at leading edges of the loosening nozzle 33 and the separation nozzle 34 arranged at the center. An uppermost stream end of the conveyance guide 65 is positioned below the suction conveyance belt 21 and upstream of a downstream end of the suction conveyance belt 21.

Therefore, the conveyance guide 65 can also be horizontally arranged without being inclined according to an arrangement relationship between the loosening nozzle 33 and the separation nozzle 34. More specifically, if the height of the uppermost stream end of the conveyance guide 65 in a vertical direction is lower than the height of a sheet attraction surface of the suction conveyance belt 21, the guide surface 65*f* of the conveyance guide 65*a* reliably guides a sheet to be attracted and conveyed by the suction conveyance belt 21.

Figure 2:
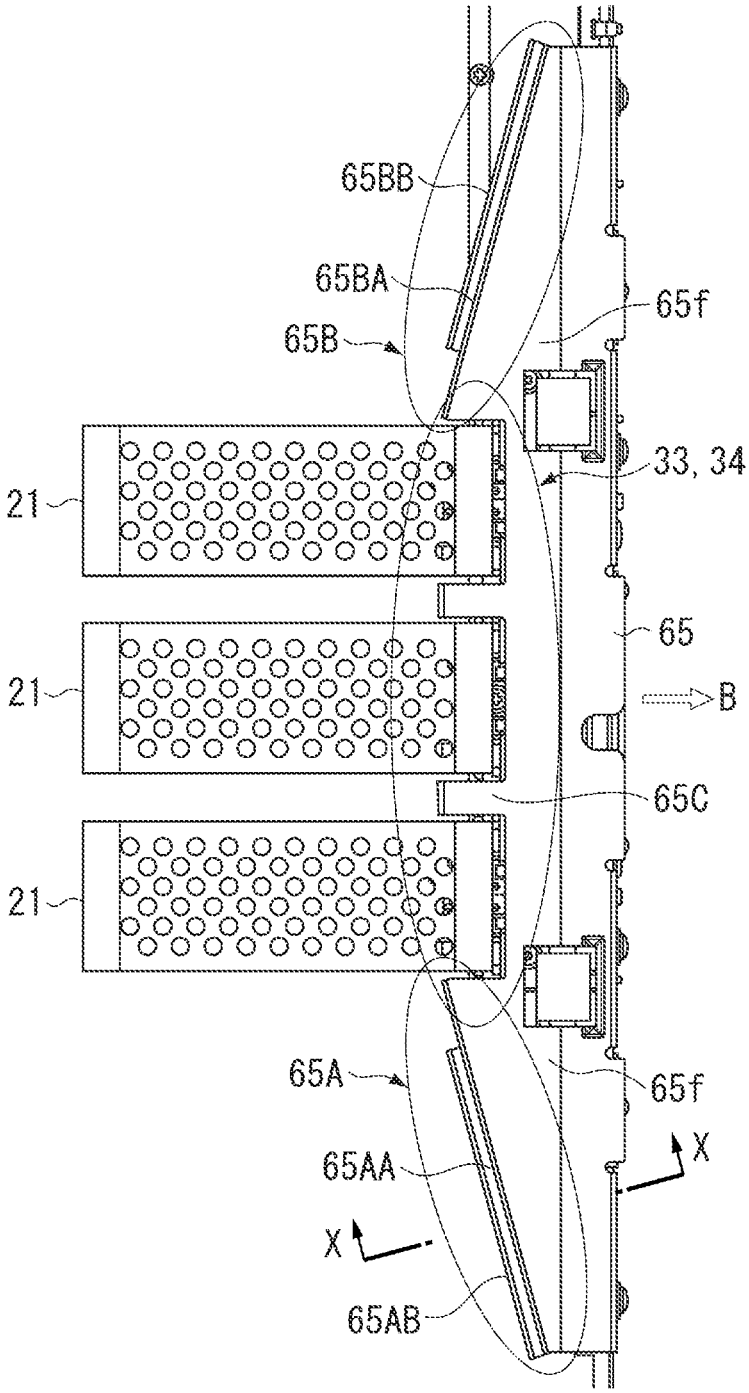
FIG. 2 is a plan view of the sheet feeding apparatus illustrated in FIG. 1.

FIG. 2 is a top perspective view of the conveyance guide 65. The guide surface 65*f* of the conveyance guide 65 has, in the sheet conveyance direction indicated by an arrow B illustrated in FIG. 2, inclined portions 65A and 65B which are inclined from the upstream side to the downstream side and formed therein from the center to both ends in the sheet width direction. The conveyance guide 65 is formed by bending using a sheet metal. The inclined portions 65A and 65B formed on upstream end sides of the conveyance guide 65 are subjected to bending downward once to respectively form stepped portions 65AA and 65BA. After their surfaces are made substantially horizontal once, the inclined portions 65A and 65B are further subjected to bending downward to respectively form stepped portions 65AB and 65BB.

Figure 3:
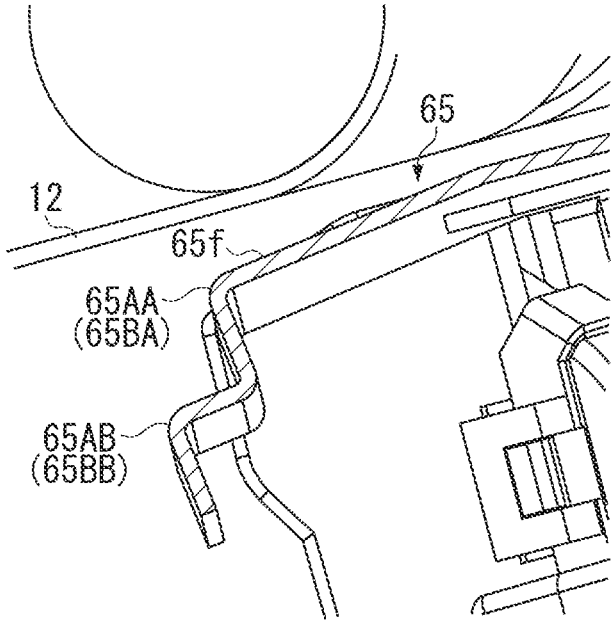
FIG. 3 is a cross-sectional view taken along a line X-X illustrated in FIG. 2.

FIG. 3 illustrates a cross section taken along a line X-X illustrated in FIG. 2 in the stepped portions 65AA and 65AB of the conveyance guide 65. As illustrated in FIG. 3, the stepped portions 65AA and 65AB of the conveyance guide 65 are provided at two positions respectively spaced in a direction away from the guide surface 65*f*, and are further arranged so that the farther the stepped portion is away from the guide surface 65*f*, the more upstream in the sheet conveyance direction it is positioned. The stepped portions 65BA and 65BB of the conveyance guide 65 are similarly arranged.

The inclined portions 65A and 65B guide a sheet such that a hanging edge of the sheet is lifted onto the guide surface 65*f* of the conveyance guide 65, as described below. At this time, in order to reduce a resistance force generated when the sheet is slidingly rubbed against the inclined portions 65A and 65B, it is effective that the conveyance guide 65 is formed by bending. More specifically, projecting folded portions of the stepped portions 65AB and 65BB of the inclined portions 65A and 65B in the conveyance guide 65 are in a curved shape (a circular arc shape) in the cross section, as illustrated in FIG. 3. Therefore, a resistance force generated when a leading edge of the sheet abuts thereon is smaller than that generated when the stepped portions are formed into edges.

Even if the stepped portions are formed into edges, an effect of causing the sheet to be lifted onto the guide surface 65*f* remains unchanged. However, in that case, a mold bur or the like is required to be removed so that the sheet is not caught on the stepped portions. Thus, projecting folded portions of the stepped portions in the conveyance guide 65 may desirably be formed in a curved shape by bending as in the present exemplary embodiment.

The inclined portions 65A and 65B are symmetric with respect to the sheet conveyance center in the sheet width direction. The conveyance guide 65 is made so large that ends of the inclined portions 65A and 65B are positioned outside the maximum sheet width in which the sheet can be conveyed in the sheet width direction.

Figure 4A:
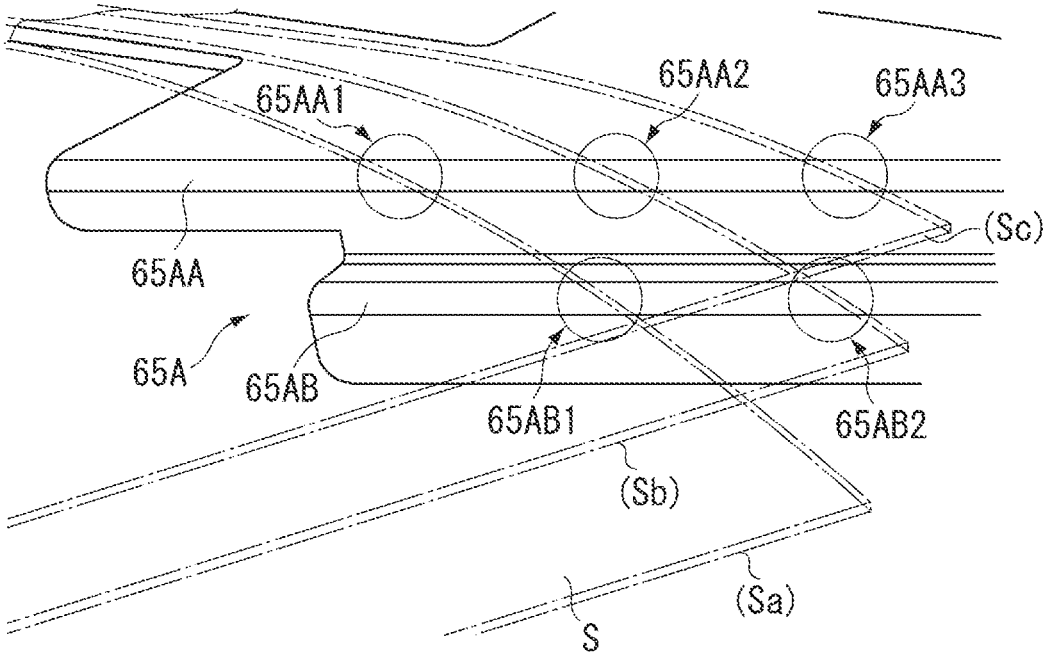
FIGS. 4A and 4B illustrate an operation of a sheet in the sheet feeding apparatus illustrated in FIG. 1.
Figure 4B:
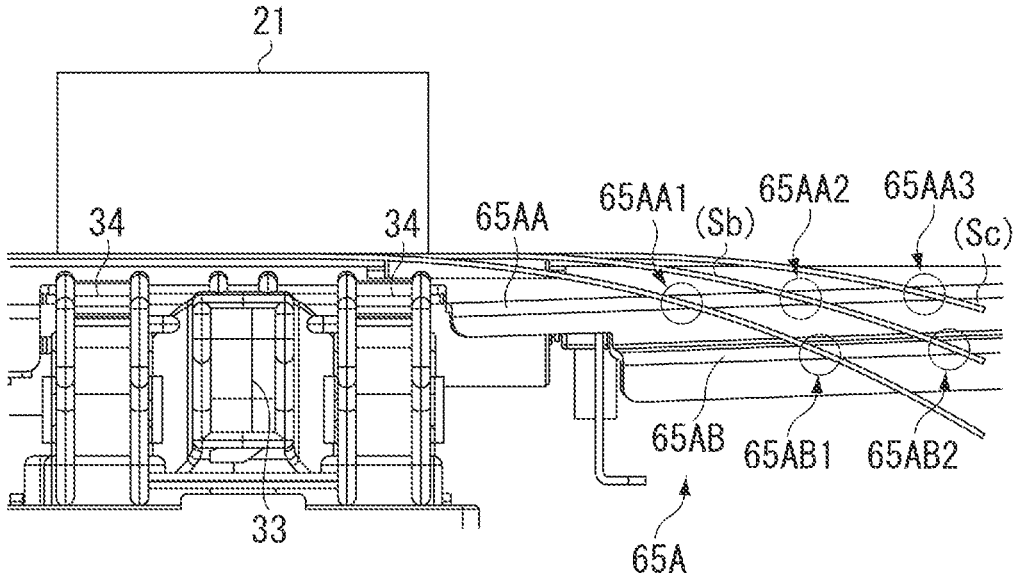

FIGS. 4A and 4B illustrate how the conveyance guide 65 lifts a hanging edge of a sheet S. FIG. 4A is a perspective view of the sheet feeding apparatus as viewed from behind, and FIG. 4B illustrates the sheet feeding apparatus as viewed from behind. The inclined portions 65A and 65B of the conveyance guide 65 are bilaterally symmetric. Therefore, only the inclined portion 65A is illustrated in FIGS. 4A and 4B. States Sa, Sb, and Sc indicate that the edge of the sheet S is sequentially lifted by the inclined portion 65A while the sheet S is gradually conveyed.

As illustrated in FIGS. 4A and 4B, the sheet S that has been attracted to the suction conveyance belt 21 is in the state Sa illustrated in FIG. 4A where its edge hangs before it abuts on the conveyance guide 65. The suction conveyance belt 21 conveys the sheet S, and a leading edge of the sheet S contacts points 65AA1 and 65AB1 in the stepped portions 65AA and 65AB of the conveyance guide 65 almost simultaneously. Consequently, the sheet S is gradually lifted along bent outer surfaces of the stepped portions 65AA and 65AB of the conveyance guide 65.

Figure 8:
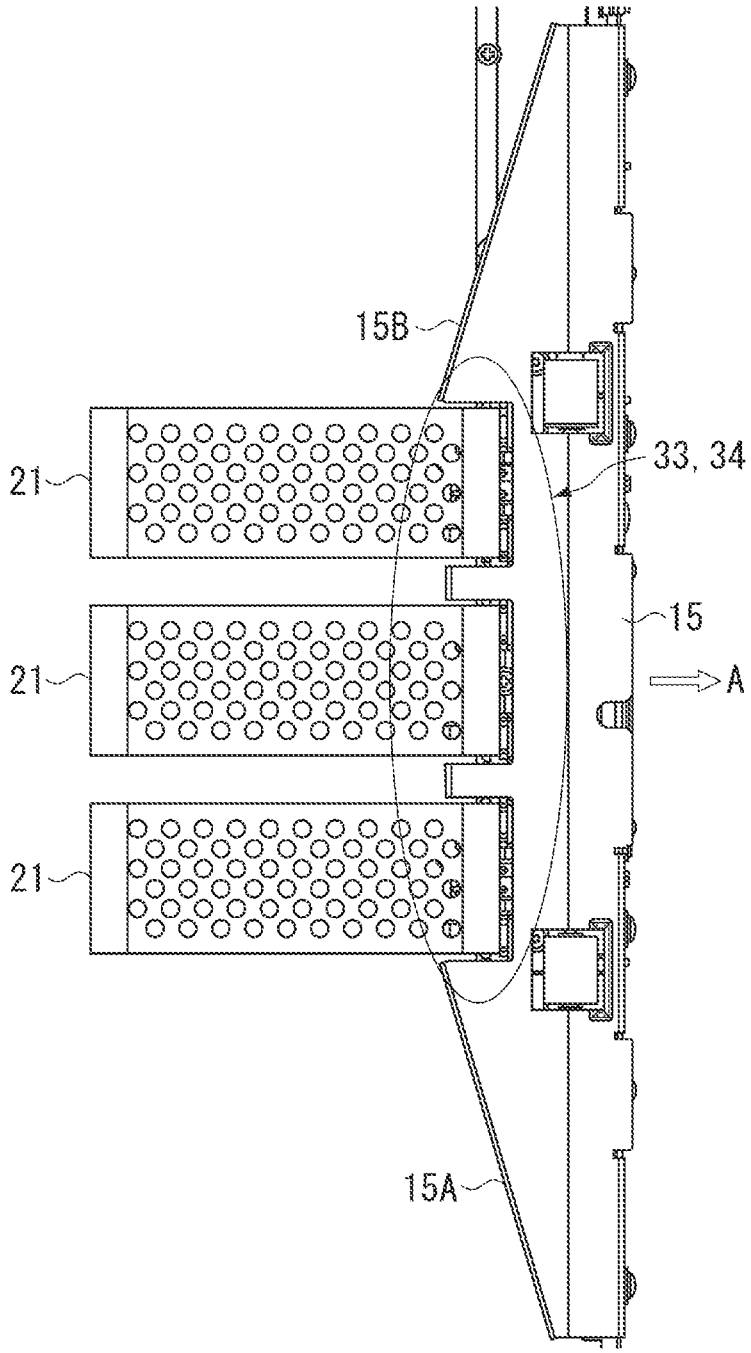
FIG. 8 is a plan view of the conventional sheet feeding apparatus.
Figure 9A:
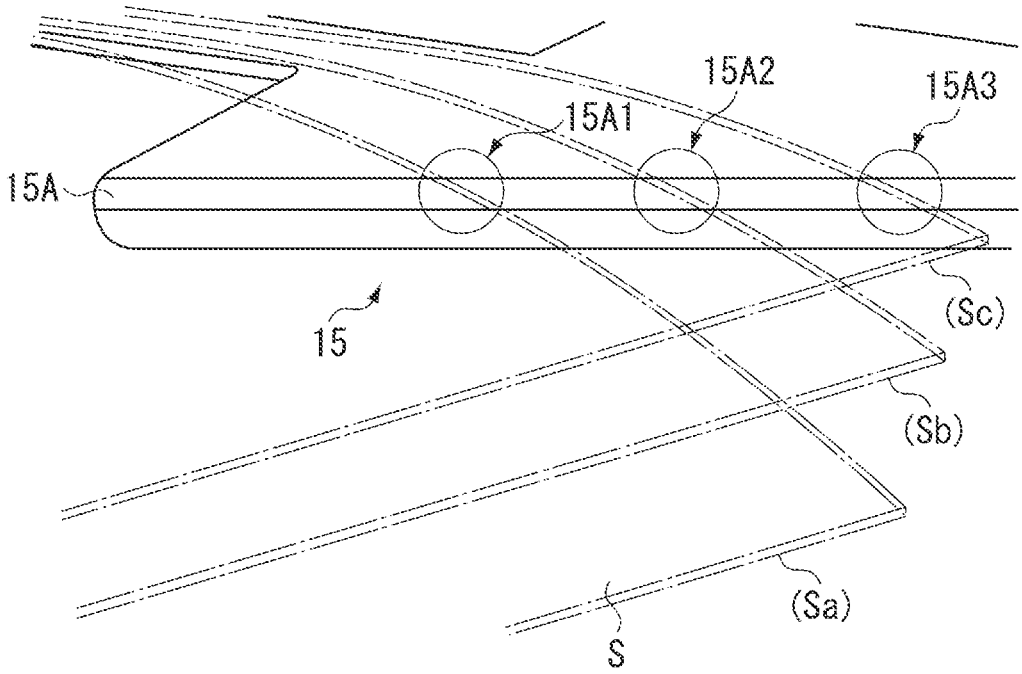
FIGS. 9A and 9B illustrate an operation of a sheet in the conventional sheet feeding apparatus.
Figure 9B:
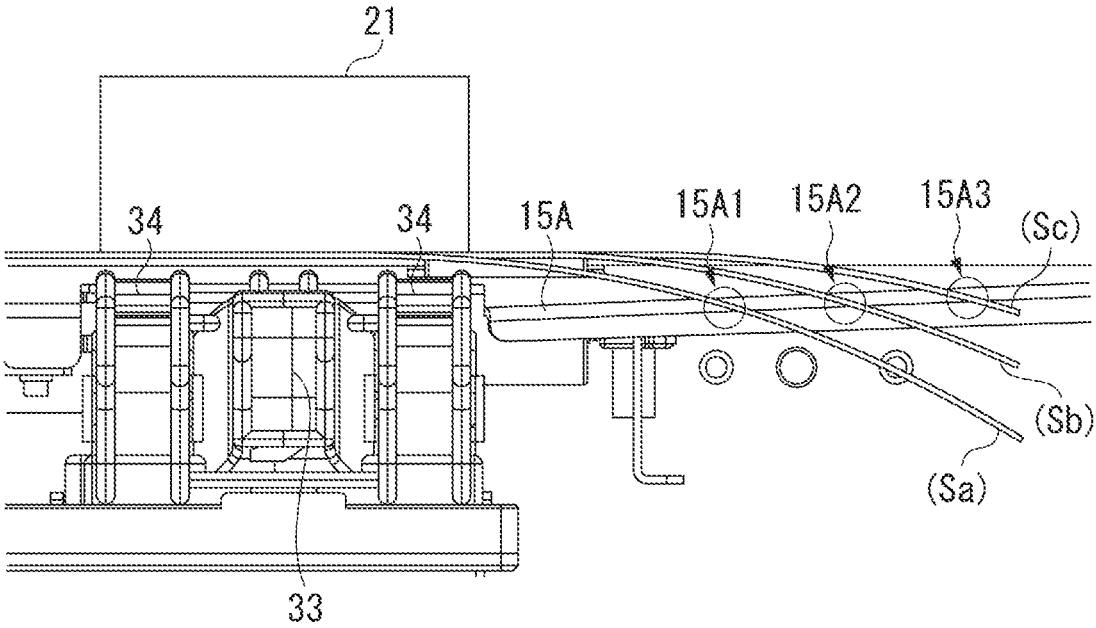

The stepped portions 65AA and 65AB are shifted in a vertical direction and a conveyance direction. When only one inclined portion is provided at each end of the conveyance guide 15, as illustrated in FIGS. 8 and 9 in the conventional technique, an impact force received when a sheet contacts the conveyance guide 65 is significantly great. Therefore, the leading edge of the sheet may be corner-folded or jammed by the impact force, so that the sheet may be damaged and not satisfactorily lifted.

In the present exemplary embodiment, each of the inclined portions 65A and 65B at the both ends of the conveyance guide 65 is formed into a plurality of stepped portions, and the edge of the sheet collides with the stepped portions almost simultaneously. Therefore, the impact force during the collision is dispersed and reduced, and the edge of the sheet is prevented from being corner-folded or jammed, so that the sheet can be reliably lifted.

When the sheet S is conveyed while being slightly inclined, the respective times when the sheet S contacts the inclined portions 65A and 65B of the conveyance guide 65 are expected to slightly deviate. Even in this case, the sheet S first contacts the one inclined portion of the conveyance guide 65 to receive the impact force, and then contacts the subsequent inclined portion at hardly any interval to ease the impact force. Therefore, the sheet can be lifted.

As the sheet S is conveyed, contact points of the stepped portions 65AA and 65AB of the conveyance guide 65 then gradually moves to points 65AA2 and 65AB2 outside the sheet S and further moves to a point 65AA3, so that the sheet S is changed to states Sb and Sc. More specifically, the sheet S is guided to the sheet conveyance unit located downstream smoothly while its hanging edge is lifted by the plurality of stepped portions 65AA and 65AB of the conveyance guide 65.

While only the inclined portion 65A on one side has been described above, the sheet S is similarly guided by the inclined portion 65B of the other side, and hence the description thereof is not repeated.

As described above, even if both edges of the sheet S hang, the sheet S is guided while being lifted onto the conveyance guide 65 without being corner-folded or jammed, and is reliably conveyed to the image forming unit.

According to the present exemplary embodiment, the inclined portions 65A and 65B are symmetric in the sheet width direction with respect to the sheet conveyance center. Therefore, a load applied when the hanging sheet is lifted onto the conveyance guide 65 is equivalent on the back side and the front side. Therefore, the sheet is not conveyed while being inclined when both its edges are lifted.

In the sheet feeding apparatus according to the present exemplary embodiment, when coated paper having a grammage of less than 80 g/m$^2$, non-coated paper having a grammage of less than 50 g/m$^2$, or a large-sized sheet having a length of more than 13 inches (approximately 330 mm) in a direction perpendicular to a conveyance direction is fed, the sheet can be reliably fed. Further, the sheet feeding apparatus according to the present exemplary embodiment is also effective when a sheet having an edge previously curled is used or in a use environment where both edges of a sheet greatly hang.

While two steps (rows) of inclined portions are provided in the present exemplary embodiment, three or more steps (rows) of inclined portions may be provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-168045 filed Jul. 27, 2010, which is hereby incorporated by reference herein in its entirety.

What is claimed is:

1. A sheet feeding apparatus comprising:

a sheet storage unit configured to store sheets;

an air blowing unit configured to blow air onto the sheets stored in the sheet storage unit;

a suction conveyance unit arranged in an upper part of the sheet storage unit and configured to attract and convey a sheet that is floated by air blown by the air blowing unit;

a sheet conveyance unit arranged downstream in a sheet conveyance direction of the suction conveyance unit and configured to convey the sheet, which is conveyed by the suction conveyance unit, downstream; and a conveyance guide which has a guide surface configured to guide a sheet to be attracted by the suction conveyance unit and conveyed to the sheet conveyance unit, wherein the conveyance guide has first inclined portions and second inclined portions which are arranged upstream in the sheet conveyance direction and are formed into stepped portions, wherein the first and second inclined portions are formed therein from sides of a sheet conveyance center to ends in a sheet width direction perpendicular to the sheet conveyance direction and inclined from an upstream side towards the downstream in the sheet conveyance direction, and wherein the second inclined portions are away from the suction conveyance unit at a distance that is farther than a distance by which the first inclined portions are away from the suction conveyance unit, and wherein the second inclined portions are positioned in the sheet conveyance direction at a location that is more upstream than a location at which the first inclined portions are positioned.

2. The sheet feeding apparatus according to claim 1, wherein projecting folded portions of stepped portions have curved shapes.

3. The sheet feeding apparatus according to claim 1, wherein the inclined portions of the conveyance guide are formed by bending.

4. The sheet feeding apparatus according to claim 1, wherein the conveyance guide has a shape that is symmetric with respect to a sheet conveyance center in the sheet width direction perpendicular to the sheet conveyance direction.

5. The sheet feeding apparatus according to claim 1, wherein both ends of each of the first and second inclined portions of the conveyance guide are positioned outside a maximum sheet width in which the sheet can be conveyed in the sheet width direction.

6. An image forming apparatus having a sheet feeding apparatus configured to feed a sheet and an image forming unit configured to form an image on the sheet fed from the sheet feeding apparatus, the image forming apparatus comprising:

a sheet storage unit configured to store sheets;

an air blowing unit configured to blow air onto sheets stored in the sheet storage unit;

a suction conveyance unit arranged in an upper part of the sheet storage unit and configured to attract and convey a sheet that is floated by air blown by the air blowing unit;

a sheet conveyance unit arranged downstream in a sheet conveyance direction of the suction conveyance unit and configured to convey the sheet, which is conveyed by the suction conveyance unit, downstream; and a conveyance guide which has a guide surface configured to guide a sheet to be attracted by the suction conveyance unit and conveyed to the sheet conveyance unit, wherein the conveyance guide has first inclined portions and second inclined portions which are arranged upstream in the sheet conveyance direction and are formed into stepped portions, wherein the first and second inclined portions are formed therein from sides of a sheet conveyance center to ends in a sheet width direction perpendicular to the sheet conveyance direction, and inclined from an upstream side towards the downstream in the sheet conveyance direction, and wherein the second inclined portions are away from the suction conveyance unit at a distance that is farther than a distance by which the first inclined portions are away from the suction conveyance unit, and wherein the second inclined portions are positioned in the sheet conveyance direction at a location that is more upstream than a location at which the first inclined portions are positioned.

7. The image forming apparatus according to claim 6, wherein projecting folded portions of stepped portions have curved shapes.

8. The image forming apparatus according to claim 6, wherein the inclined portions of the conveyance guide are formed by bending.

9. The image forming apparatus according to claim 6, wherein the conveyance guide has a shape that is symmetric with respect to a sheet conveyance center in the sheet width direction perpendicular to the sheet conveyance direction.

10. The image forming apparatus according to claim 6, wherein both ends of each of the first and second inclined portions of the conveyance guide are positioned outside a maximum sheet width in which the sheet can be conveyed in the sheet width direction.

* * * * *